US005935921A

United States Patent [19]

Meunier

[11] Patent Number: 5,935,921

[45] Date of Patent: Aug. 10, 1999

[54] LIQUID DESCALING COMPOSITION

[75] Inventor: Philippe Meunier, Paris, France

[73] Assignee: Colgate-Palmolive Co., Piscataway, N.J.

[21] Appl. No.: 09/237,066

[22] Filed: Jan. 26, 1999

[51] Int. Cl.[6] ..... C11D 1/75; C11D 1/62; C11D 3/06

[52] U.S. Cl. ..... 510/247; 510/238; 510/245; 510/253; 510/254; 510/269; 510/271; 510/273; 510/362; 510/363; 510/384; 510/467; 510/499; 510/503; 510/504; 510/505; 510/510

[58] Field of Search ..... 510/245, 247, 510/253, 254, 256, 269, 271, 273, 362, 363, 467, 499, 503, 504, 505, 510, 384, 191, 238, 521, 522

[56] References Cited

U.S. PATENT DOCUMENTS

| | | | |
|---|---|---|---|
| 3,223,643 | 12/1965 | Law | 510/384 |
| 4,666,622 | 5/1987 | Martin et al. | 252/186.22 |
| 4,976,885 | 12/1990 | Wisotzki et al. | 510/432 |
| 5,008,030 | 4/1991 | Cook et al. | 510/384 |
| 5,039,441 | 8/1991 | Thomas et al. | 510/238 |
| 5,047,095 | 9/1991 | Geke et al. | 148/259 |
| 5,192,460 | 3/1993 | Thomas et al. | 510/238 |
| 5,656,580 | 8/1997 | Carrie et al. | 510/362 |
| 5,672,578 | 9/1997 | Carrie et al. | 510/245 |
| 5,733,859 | 3/1998 | Carrie et al. | 510/362 |
| 5,736,496 | 4/1998 | Durbut et al. | 510/235 |
| 5,770,554 | 6/1998 | Misselyn et al. | 510/426 |

FOREIGN PATENT DOCUMENTS

| | | |
|---|---|---|
| 0353817 | 2/1990 | European Pat. Off. . |
| WO 97/06228 | 2/1997 | WIPO . |
| WO 97/44428 | 11/1997 | WIPO . |

*Primary Examiner*—Kery Fries
*Assistant Examiner*—Brian Mruk
*Attorney, Agent, or Firm*—Richard E. Nanfeldt

[57] ABSTRACT

The present invention relates to a liquid descaling composition containing a phosphoric acid, a phosphonic acid, a cationic surfactant, an amine oxide and water.

3 Claims, No Drawings

LIQUID DESCALING COMPOSITION

FIELD OF THE INVENTION

The present invention relates to a descaling liquid composition, wherein the composition contains phosphoric acid, an amine trialkyl phosphonic acid, an amine oxide surfactant, a cationic surfactant and water, wherein the composition is free of perfume and does not contain an organic acid such as citric acid, maleic acid, succinic or adipic acid.

BACKGROUND OF THE INVENTION

The present invention relates to the removal of lime scale build up deposits from the interior of automatic dishwashing machines, coffee machines, steam irons, cooking appliances, tea pots or any other machine using water having a high calcium ion concentration, wherein it is necessary that the composition be both free of organic acids and perfumes such that undesirable odors are not left on the machine being cleaned.

European Patent Application No. 93870120 and EP066303 both disclose cleaning compositions that contain maleic acid.

U.S. Pat. Nos. 5,008,030 and 5,192,460 disclose an acid disinfectant cleaning composition containing phosphoric acid and an amine trialkyl phosphonic, anionic or ethoxylated nonionic surfactants and a perfume.

SUMMARY OF THE INVENTION

The present invention relates to a descaling liquid cleaning composition for the removal of limescale build up from the interior of appliances which employ water having a high calcium concentration. The descaling liquid composition which has a pH of about 1 to about 5 contains phosphoric acid, an amino trialkyl phosphonic acid, a cationic surfactant, an amine oxide surfactant and water.

Accordingly, an object of the present invention is to provide a cleaning composition which has a low foam profile and is capable of removing limescale build up.

Another objection of the present invention is to provide a liquid descaling composition which is free of perfumes and maleic acid.

DETAILED DESCRIPTION OF THE INVENTION

The present invention relates to a liquid descaling cleaning composition which comprises approximately by weight:

(a) 24% to 36%, more preferably 26% to 34% of phosphoric acid;

(b) 0.25% to 5%, more preferably 1% to 3% of an amino trialkyl phosphonic acid;

(c) 1% to 10%, more preferably 2% to 8% of an amine oxide surfactant, (d) 0.5% to 6%, more preferably 1 % to 5% of a cationic surfactant;

(e) 0.1% to 4%, more preferably 0.4% to 2% of a $C_2$–$C_4$ alkanol such as isopropyl alcohol; and (f) the balance being water, wherein the composition does not contain an ethoxylated and/or propoxylated nonionic surfactant, maleic acid, citric acid, succinic acid, adipic acid, a zwitterionic surfactant, an anionic surfactant, a perfume, an essential oil, a water insoluble hydrocarbon, a glycol ether cosurfactant and a glycol ester cosurfactant and the composition is not a microemulsion.

The instant compositions contain about 0.5 to about 6 wt. %, more preferably 1 to 5 wt. % of a cationic surfactant selected from the group consisting of a $C_8$–$C_{16}$ alkyl benzyl dimethyl ammonium chlorides, $C_8$–$C_{16}$ dialkyl dimethyl ammonium chlorides and $C_8$–$C_{16}$ alkyl, $C_8$–$C_{14}$ alkyl dimethyl ammonium chloride and chlorhexidine and mixtures thereof. A preferred cationic surfactant is didecyl dimethyl ammonium chloride. Some typical disinfectant agent useful in the instant compositions are manufactured by Lonza, S. A. They are: Bardac 2180 (or 2170) which is N-decyl-N-isonoxyl-N, N-dimethyl ammonium chloride; Bardac 22 which is didecyl dimethyl ammonium chloride; Bardac LF which is N,N-dioctyl-N, N-dimethyl ammonium chloride; Bardac 114 which is a mixture in a ratio of 1:1:1 of N-alkyl-N, N-didecyl-N, N-dimethyl ammonium chloride/N-alkyl-N, N-dimethyl-N-ethyl ammonium chloride; and Barquat MB-50 which is N-alkyl-N, N-dimethyl-N-benzyl ammonium chloride.

The amine oxides are used at a concentration 1 to 10 wt. %, more preferably 2 to 8 wt. % in forming the light duty liquid compositions are depicted by the formula:

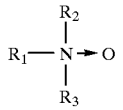

wherein $R_1$ is a $C_{10}$–$C_{18}$ linear or branched chain alkyl group, $R_2$ is a $C_1$–$C_{16}$ linear alkyl group and $R_3$ is a $C_1$–$C_{16}$ linear alkyl group, or the amido radical:

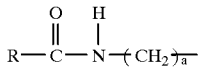

wherein R is an alkyl group having about 9 to 19 carbon atoms and a is the integer 1 to 4: $R_2$ and $R_3$ are each alkyl groups having 1 to 3 carbons and preferably 1 carbon.

The amino phosphonic acids are used at a concentration of 0.25 to 5 wt. %, more preferably 1 to 3 wt. %. Phosphonic acid apparently exists only theorectically, but its amino derivatives are stable and are useful in the practice of the present invention. Such are considered to be phosphonic acids, as that term is used in this specification. The phosphonic acids are of the structure:

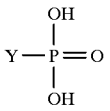

wherein Y is any suitable substituent, but preferably Y is alkylamino or N-substituted alkylamino. For example, a preferred phosphonic acid component of the present emulsions is aminotris-(methylenephosphonic) acid, which is of the formula $N(CH_2PH_2O_3)_3$. Among other useful phosphonic acids are ethylenediamine tetra-(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogens, 3 to 5 lower alkylenephosphonic acid groups in which the lower alkylene is of 1 or 2 carbon atoms, and 0 to 2 alkylene groups of 2 to 6 carbon atoms each, which alkylene(s) is/are present and 30 in amino nitrogens when a plurality of such amino nitrogens is present in the aminoalkylenephosphonic acid. It has been found that such aminoalkylene phosphonic acids, which also may be partially neutralized at the desired pH of the microemulsion cleaner, are of desired stabilizing and protecting effect in the invented cleaner, especially when present with phosphoric acid, preventing harmful attacks on European enamel surfaces by the "organic acid" component(s) of the cleaner. Usually the phosphorus acid salts, if present, will be monosalts of each of the phosphoric and/or phosphonic acid groups present.

The water that is used in making the present microemulsions may be tap water but is preferably of low hardness, normally being less than 150 parts per million (p.p.m.) of hardness, as calcium carbonate. Still, useful cleaners can be made from tap waters that are higher in hardness, up to 300 p.p.m, as $CaCO_3$. Most preferably the water employed will be distilled or deionized water, in which the content of hardness ions is less than 25 p.p.m., usually being nil. Employment of such deionized water allows for the manufacture of a product of consistently good qualities, independent of hardness variations in the aqueous medium.

Various other components may desirably be present in the invented cleaners, including preservatives, antioxidants or corrosion inhibitors, multivalent metals or metal ions and various other adjuvants conventionally employed in liquid detergents and hard surface cleaners may also be present, provided that they do not interfere with the cleaning and scum and scale-removal functions of the cleaner.

The cleaner may desirably packed in manually operated spray dispensing container, which are usually and preferably made of synthetic organic polymeric plastic material, such as polyethylene, polypropylene or polyvinyl chloride (PVC). Such containers also preferably include nylon or other non-reactive plastic closure, spray nozzle, dip tube and associated dispenser parts, and the resulting packaged cleaner is ideally suited for use in "spray and wipe" applications. However, in some instances, as when lime scale and soap scum deposits are heavy, the cleaner may be left on until it has dissolved or loosened the deposits, and may then be wiped off, or may be rinsed off, or multiple applications may be made, followed by multiple removals, until the deposits are gone. For spray applications the viscosity of the microemulsion (or ordinary emulsion, if that is used instead) will desirably be increased so that the liquid adheres to the surface to be cleaned, which is especially important when such surface is vertical, to prevent immediate run-off of the cleaner and consequent loss of effectiveness. Sometimes, the product may be formulated as an "aerosol spray type", so that is foam discharged from the aerosol container will adhere to the surface to be cleaned. At other times the aqueous medium may be such as to result in a gel or paste, which is deposited on the surface by hand application, preferably with a sponge or cloth, and is removed by a combination of rinsing and wiping, preferably with a sponge, after which it may be left to dry to a shine, or may be dried with a cloth. Of course, when feasible, the cleaned surface may be rinsed to remove all traces of acid from it.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. The exemplified compositions are illustrative only and do not limit the scope of the invention. Unless otherwise specified, the proportions in the examples and elsewhere in the specification are by weight.

EXAMPLE 1

The following formula in wt. % was made by simple mixing at room temperature:

| | |
|---|---|
| Phosphoric acid | 30.00 |
| Aminotrimethyl phosphonic acid | 1.5 |
| Cocoamidopropyldimethyl amine oxide | 2.7 |
| Didecyl dimethyl ammonium chloride | 1.94 |
| Isopropyl alcohol | 0.85 |
| Water | Balance |
| pH | 2.0 |

What is claimed:

1. A lime scale cleaning composition comprising approximately by weight:

(a) 24% to 36% of phosphoric acid;

(b) 0.25% to 5% of a phosphonic acid, wherein said phosphonic acid is an amino trialkyl phosphonic acid;

(c) 1% to 10% of an amine oxide;

(d) 0.5% to 6% of a cationic surfactant;

(e) the balance being water; and (f) a $C_2$ –$C_4$ alkanol, wherein the pH of said composition is about 2.0.

2. The composition of claim 1, wherein said cationic surfactant is selected from the group consisting of a $C_8$–$C_{14}$ alkyl benzyl dimethyl ammonium chloride, a $C_8$–$C_{16}$ dialkyl dimethyl ammonium chloride and a $C_8$–$C_{16}$ alkyl, $C_8$–$C_{14}$ alkyl dimethyl ammonium chloride and mixtures thereof.

3. The composition of claim 2, wherein said amine oxide is a cocoamidopropyl dimethyl amine oxide.

* * * * *